US007787801B2

(12) United States Patent
Koyama

(10) Patent No.: US 7,787,801 B2
(45) Date of Patent: Aug. 31, 2010

(54) IMAGE FORMING APPARATUS WITH SHIELD MEMBER

(75) Inventor: Haruo Koyama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 224 days.

(21) Appl. No.: 12/081,938

(22) Filed: Apr. 23, 2008

(65) Prior Publication Data

US 2008/0267659 A1 Oct. 30, 2008

(30) Foreign Application Priority Data

Apr. 24, 2007 (JP) ..... 2007-113798

(51) Int. Cl.
*G03G 15/00* (2006.01)

(52) U.S. Cl. ..... 399/107

(58) Field of Classification Search ..... 399/107, 399/108, 110, 126
See application file for complete search history.

(56) References Cited

U.S. PATENT DOCUMENTS 5,144,386 A * 9/1992 Matsuo et al. ..... 399/381
5,905,935 A * 5/1999 Wakamatsu et al. ..... 399/407
2005/0226645 A1 10/2005 Sone et al.
2010/0014886 A1 * 1/2010 Lee et al. ..... 399/107

FOREIGN PATENT DOCUMENTS

| | | |
|---|---|---|
| CN | 1680888 | 10/2005 |
| CN | 2756932 | 2/2006 |
| JP | 2006-126605 | 5/2006 |

OTHER PUBLICATIONS

Chinese Office Action issued Oct. 16, 2009 for application No. 2008100898118.

* cited by examiner

*Primary Examiner*—Hoan Tran
(74) *Attorney, Agent, or Firm*—Smith, Gambrell & Russell, LLP

(57) ABSTRACT

An image forming apparatus includes an apparatus cabinet having a bottom face opposed to a floor surface and a front face for operating the apparatus, a plurality of foot members disposed on the bottom face for supporting the apparatus on the floor surface in a movable manner, and a shield member for shielding a gap formed between the bottom face and the floor surface at least at the side of the front face of the apparatus.

20 Claims, 9 Drawing Sheets

IMAGE FORMING APPARATUS WITH SHIELD MEMBER

This application is based on Japanese Patent Application No. 2007-113798 filed on Apr. 24, 2007, the contents of which are hereby incorporated by reference.

BACKGROUND OF THE INVENTION

1. Field of the Invention

The present invention relates to an image forming apparatus such as a copying machine, a facsimile, a printer or the like. In particular, the present invention relates to an image forming apparatus having foot members for supporting the apparatus on a floor surface.

2. Description of Related Art

Conventionally, there are various types of image forming apparatuses from a small desktop type to a large floorstanding type. Some of these types of image forming apparatuses are equipped with four foot members such as casters at four corners or their vicinities on the bottom face of the apparatus. These casters enable the apparatus to be moved easily while they enable the apparatus to be fixed on a floor surface by locking themselves when the apparatus is installed. In addition, some of the apparatuses have a structure for adjusting its level by the casters that are screwed to the apparatus so that screw height of each caster can be adjusted, thereby all the casters can contact with the floor surface. Thus, the image forming apparatus can be prevented from being unstable and still can move easily.

However, providing four casters may cause an increase of cost. Therefore, an apparatus disclosed in JP-A-2006-126605, for example, has fixed foot members and two casters attached to the bottom face of a cabinet of the apparatus. The casters are attached to the bottom face of the cabinet at the outside of the fixed foot members on one end side of the bottom face, and a height of the caster is lower than that of the foot member. According to this arrangement, the apparatus can be moved by lifting and tilting the same so that only the casters contact with the floor surface while the apparatus can be supported and fixed to the floor surface only by the fixed foot members so that the casters do not contact with the floor surface when the apparatus is installed.

However, in the apparatus disclosed in the above-mentioned patent document, the casters for moving the apparatus are disposed on the bottom face of the apparatus cabinet. Therefore, there is a gap between the bottom face of the apparatus cabinet and the floor surface generated when the apparatus is installed. If an original sheet or a sheet of paper on which images are formed is dropped on the floor surface when the image forming apparatus is used for printing or copying, the original sheet or the sheet of paper may slip into the gap. The casters of the installed apparatus are locked, and the apparatus having the fixed foot members and the casters is supported by the fixed foot members on the floor surface. Therefore, it is difficult to move the apparatus, and the original sheet or the sheet of paper cannot be taken out from the gap easily. Furthermore, if a post-processing device is attached to the image forming apparatus, it is more difficult to move the apparatus, so the original sheet or the sheet of paper cannot be taken out from the gap easily. In addition, if the apparatus is installed so that its rear side faces a wall of a room such as an office, or if it is installed so that both the rear side and one lateral side face walls in some cases, dust may be deposited in the gap and the dust may stick to the original sheet or the sheet of paper to make it dirty even if it can be taken out from the gap.

SUMMARY OF THE INVENTION

It is an object of the present invention to provide an image forming apparatus that can be moved by foot members disposed on a bottom face of an apparatus cabinet and can prevent a foreign matter such as an original sheet or a sheet of paper from slipping into a gap between a bottom face of the apparatus cabinet and the floor surface.

An image forming apparatus according to an embodiment of the present invention includes an apparatus cabinet having a bottom face opposed to a floor surface and a front face for operating the apparatus, a plurality of foot members disposed on the bottom face for supporting the apparatus on the floor surface in a movable manner, and a shield member for shielding a gap formed between the bottom face and the floor surface at least at the side of the front face of the apparatus.

According to this structure, at least at the front face of the apparatus, the shield member can prevent a foreign matter such as an original sheet or a sheet of paper from slipping into the gap formed between the bottom face of the apparatus cabinet and the floor surface.

Therefore, a foreign matter such as an original sheet or a sheet of paper does not enter the gap formed between the bottom face of the apparatus cabinet and the floor surface at the front face side of the apparatus.

In addition, as to the image forming apparatus having the above-mentioned structure of the present invention, the shield member is capable of moving between a position for shielding the gap and a position for being stored along the bottom face. According to this structure, the shield member can be stored along the bottom face of the apparatus cabinet when the apparatus is moved. When the apparatus is installed, the shield member is pulled out from the bottom face of the apparatus cabinet so that the shield member can shield the gap between the bottom face of the apparatus cabinet and the floor surface.

Therefore, the apparatus can be moved easily by storing the shield member along the bottom face of the apparatus cabinet, and while the shield member can be pulled out from the bottom face of the apparatus cabinet for shielding the gap so that a foreign matter such as an original sheet or a sheet of paper cannot enter the gap when the apparatus is installed.

In addition, as to the image forming apparatus having the above-mentioned structure of the present invention, the shield member is detachable from the apparatus. According to this structure, the shield member can be removed from the apparatus when the apparatus is moved. When the apparatus is installed, the shield member is attached to the apparatus so that the shield member can shield the gap between the bottom face of the apparatus cabinet and the floor surface.

Therefore, the apparatus can be moved easily by removing the shield member from the apparatus, and the shield member is attached to the apparatus at the gap formed between the bottom face of the apparatus cabinet and the floor surface when the apparatus is installed so that the shield member shields the gap for preventing a foreign matter such as an original sheet or a sheet of paper from entering the gap.

In addition, as to the image forming apparatus having the above-mentioned structure of the present invention, the shield member has a sheet-like shape. According to this structure, the sheet-like shield member can be stored along the bottom face of the apparatus cabinet or can be removed when the apparatus is moved. When the apparatus is installed, the sheet-like shield member can shield the gap between the bottom face of the apparatus cabinet and the floor surface.

Therefore, the shield member can be stored along the bottom face of the apparatus cabinet without an increase of dimensions of the apparatus when the apparatus is moved. When the apparatus is installed, the shield member shields the gap between the bottom face of the apparatus cabinet and the floor surface for preventing a foreign matter such as an original sheet or a sheet of paper from entering the gap.

In addition, as to the image forming apparatus having the above-mentioned structure of the present invention, the shield member is made up of a plurality of band-like plates. According to this structure, the plurality of band-like plates can be stored along the bottom face of the apparatus cabinet or can be removed when the apparatus is moved. When the apparatus is installed, the plurality of band-like plates are pulled out from the bottom face of the apparatus cabinet so that the plurality of band-like plates can shield the gap between the bottom face of the apparatus cabinet and the floor surface.

Therefore, the shield member can be stored along the bottom face of the apparatus cabinet without an increase of dimensions of the apparatus when the apparatus is moved. When the apparatus is installed, the shield member shields the gap between the bottom face of the apparatus cabinet and the floor surface for preventing a foreign matter such as an original sheet or a sheet of paper from entering the gap.

In addition, as to the image forming apparatus having the above-mentioned structure of the present invention, the foot member includes a caster that can rotate for moving on the floor surface and a fixed foot member that can move between the floor surface and the bottom face, and the shield member moves between the floor surface and the bottom face along with the movement of the fixed foot member. According to this structure, the fixed foot member is moved toward the bottom face of the apparatus cabinet so that the shield member can be stored along the bottom face of the apparatus cabinet when the apparatus is moved. When the apparatus is installed, the fixed foot member is moved toward the floor surface so that the shield member also moves toward the floor surface so as to shield the gap between the bottom face of the apparatus cabinet and the floor surface.

Therefore, the shield member can be stored along the bottom face of the apparatus cabinet only by moving the fixed foot member toward the bottom face of the apparatus cabinet when the apparatus is moved. If the fixed foot member is moved toward the floor surface for adjusting a height of the apparatus when the apparatus is installed, the shield member is also moves toward the floor surface so that the shield member shields the gap between the bottom face of the apparatus cabinet and the floor surface for preventing a foreign matter such as an original sheet or a sheet of paper from entering the gap.

In addition, as to the image forming apparatus having the above-mentioned structure of the present invention, the shield member is provided with a shaft, and the bottom face is provided with a guide member, so that the shaft is guided by a groove that is formed in the guide member. According to this structure, the shield member is stored along the bottom face of the apparatus cabinet or shields gap between the bottom face of the apparatus cabinet and the floor surface when the shaft is guided by the groove of the guide member.

Therefore, the shield member can move smoothly between a position for being stored along the bottom face of the apparatus cabinet and a position for shielding the gap between the bottom face of the apparatus cabinet and the floor surface.

In addition, as to the image forming apparatus having the above-mentioned structure of the present invention, the band-like plate extends in the lateral direction of the apparatus, and the plurality of band-like plates are arranged in the vertical direction of the apparatus and are linked with each other. According to this structure, the plurality of band-like plates move flexibly at the corner between the front face of the apparatus and the bottom face of the apparatus cabinet, so that the shield member is stored along the bottom face of the apparatus cabinet or shields the gap between the bottom face of the apparatus cabinet and the floor surface.

Therefore, the shield member can move smoothly between the position for being stored along the bottom face of the apparatus cabinet and the position for shielding the gap between the bottom face of the apparatus cabinet and the floor surface without an increase of dimensions of the apparatus.

In addition, as to the image forming apparatus having the above-mentioned structure of the present invention, the shield member is capable of moving between a front face gap formed at a front face side of the apparatus and a side face gap formed at a side face side of the apparatus. According to this structure, when the apparatus is installed, the shield member can shield a gap at the side face as well as the gap at the front face of the apparatus.

Therefore, not only the gap at the front face of the apparatus but also the gap at the side face can be shielded so that a foreign matter such as an original sheet or a sheet of paper cannot enter the gap, if necessary in accordance with the place where the apparatus is installed.

In addition, as to the image forming apparatus having the above-mentioned structure of the present invention, the shield member is capable of moving between the front face gap and one of the side face gaps. According to this structure, when the apparatus is installed, the shield member can shield a gap at the side face as well as the gap at the front face of the apparatus.

Therefore, not only the gap at the front face of the apparatus but also the gap at the side face can be shielded so that a foreign matter such as an original sheet or a sheet of paper cannot enter the gap, if necessary in accordance with the place where the apparatus is installed.

In addition, as to the image forming apparatus having the above-mentioned structure of the present invention, the shield member includes a plurality of shield pieces, each of which has a rectangular box shape elongated in the vertical direction of the apparatus, and the plurality of shield pieces are arranged in the lateral direction of the apparatus and are linked with each other. According to this structure, the plurality of shield pieces move flexibly at the corner between the front face and the side face of the apparatus, so that the shield member shields the gap at the front face and at the side face of the apparatus.

Therefore, the shield member can move smoothly between the gap at the front face and the gap at the side face of the apparatus without an increase of dimensions of the apparatus.

In addition, as to the image forming apparatus having the above-mentioned structure of the present invention, a pair of the shield members are disposed, each of which is capable of moving between the front face gap and the side face gap. According to this structure, when the apparatus is installed, the shield member can shield both the side face gaps as well as the front face gap of the apparatus.

Therefore, not only the gap at the front face of the apparatus but also the gaps at both the side faces can be shielded so that a foreign matter such as an original sheet or a sheet of paper cannot enter the gaps, if necessary in accordance with the place where the apparatus is installed.

In addition, as to the image forming apparatus having the above-mentioned structure of the present invention, the shield member has a shape like bellows that can be expanded and contracted in the lateral direction of the apparatus. When the apparatus is moved, the bellows-like shield member is contracted so as to be stored. When the apparatus is installed, the bellows-like shield member is expanded so that the shield member can shield the gap between the bottom face of the apparatus cabinet and the floor surface.

Therefore, the shield member can be stored without an increase of dimensions of the apparatus when the apparatus is moved. When the apparatus is installed, the shield member shields the gap between the bottom face of the apparatus cabinet and the floor surface for preventing a foreign matter such as an original sheet or a sheet of paper from entering the gap.

In addition, as to the image forming apparatus having the above-mentioned structure of the present invention, the shield member includes a plurality of shield pieces arranged in the lateral direction of the apparatus so as to link with each other, and a flexible member attached to the plurality of shield pieces at the end close the floor surface side. According to this structure, the plurality of shield pieces move flexibly at the corner between the front face and the side face of the apparatus, so that the shield member shields the gap between the bottom face of the apparatus cabinet and the floor surface. In addition, even if a height of the gap between the bottom face of the apparatus cabinet and the floor surface changes when a height of the apparatus is adjusted, the flexible member contacts with the floor surface so as to shield the gap between the bottom face of the apparatus cabinet and the floor surface.

Therefore, the shield member can move smoothly between the front face and the side face of the apparatus without an increase of dimensions of the apparatus. In addition, even if a height of the apparatus is adjusted, the shield member shields the gap between the bottom face of the apparatus cabinet and the floor surface so as to prevent a foreign matter such as an original sheet or a sheet of paper from entering the gap.

In addition, as to the image forming apparatus having the above-mentioned structure of the present invention, the flexible member has a shape like cloth.

In addition, as to the image forming apparatus having the above-mentioned structure of the present invention, the flexible member is formed to have a shape like fibers.

In addition, as to the image forming apparatus having the above-mentioned structure of the present invention, the shield member is made of a flexible member. According to this structure, even if a height of the gap between the bottom face of the apparatus cabinet and the floor surface changes when a height of the apparatus is adjusted, the flexible member contacts with the floor surface so as to shield the gap between the bottom face of the apparatus cabinet and the floor surface.

Therefore, even if a height of the apparatus is adjusted, the shield member shields the gap between the bottom face of the apparatus cabinet and the floor surface. Therefore, in spite of a simple structure, it is possible to prevent a foreign matter such as an original sheet or a sheet of paper from entering the gap.

DETAILED DESCRIPTION OF THE PREFERRED EMBODIMENTS

Hereinafter, embodiments of the present invention will be described with reference to the attached drawings although the present invention is not limited to these embodiments. The embodiments of the present invention show the most preferable forms of the present invention, and the application of the present invention and terms used in the description should not be interpreted in a limited manner.

Figure 1:
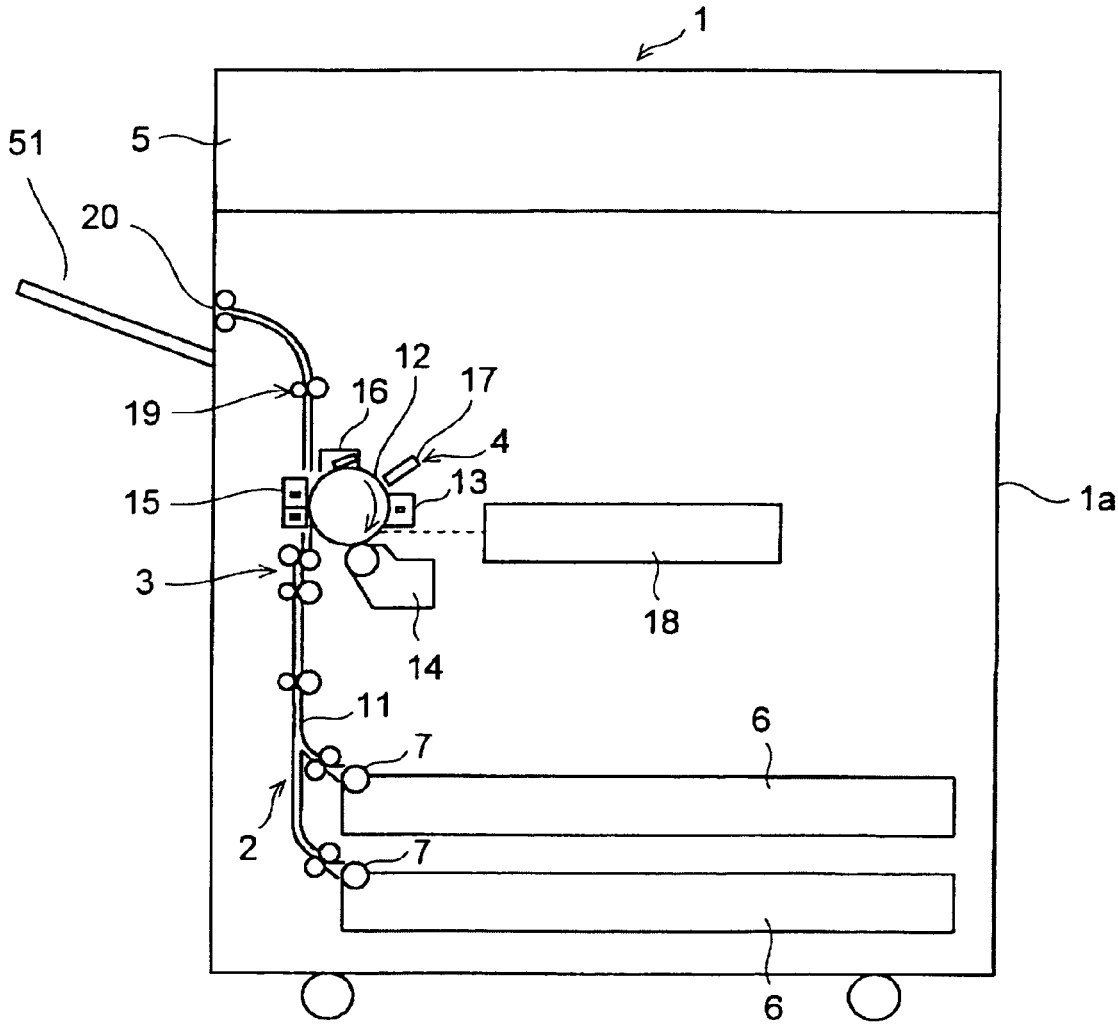
FIG. 1 is a schematic diagram showing a general structure of an image forming apparatus as an embodiment of the present invention.

FIG. 1 is a schematic diagram showing a general structure of an image forming apparatus 1 of the present invention. As shown in FIG. 1, the image forming apparatus 1 that is a digital copying machine includes a paper feeding part 2 disposed at a lower part of the apparatus, a paper carrying part 3 disposed on the side of the paper feeding part 2 and above the same, an image forming part 4 disposed on the right side of the paper carrying part 3 and an image reading part 5 disposed at an upper part of the apparatus.

The paper feeding part 2 has a plurality of paper feed cassettes 6 in which sheets of paper are stored and has a structure for feeding the sheets of paper one by one securely from the paper feed cassette 6 to the paper carrying part 3 when a paper feed roller 7 rotates.

The paper sheet is carried to the image forming part 4 via the paper carrying part 3. The image forming part 4 forms a predetermined toner image on the paper sheet by an electrophotographic process. The image forming part 4 includes a photoconductor 12 that is an image carrier supported axially in a rotatable manner in a predetermined direction (as shown in FIG. 1 by an arrow), and it also includes an electrification unit 13, a developing unit 14, a transferring unit 15, a cleaning unit 16 and an antistatic unit 17 that are disposed along the rotational direction of the photoconductor 12 around the same.

The electrification unit 13 applies a predetermined potential to a surface of the photoconductor 12 so that the surface of the photoconductor 12 is electrostatically charged in a uniform manner. Then, an electrostatic latent image is formed on the photoconductor 12 by a laser beam from a laser scanning unit 18 based on image data of an original read by the image reading part 5. Next, toner sticks to the electrostatic latent image by the developing unit 14 so that a toner image is formed on the photoconductor 12. The toner image on the surface of the photoconductor 12 is transferred by the transferring unit 15 onto the paper sheet that is fed between the photoconductor 12 and the transferring unit 15.

The paper sheet on which the toner image is transferred (hereinafter referred to as a "transfer paper sheet") is carried from the image forming part 4 to a fixing roller pair 19. The fixing roller pair 19 is disposed at the downstream side of the image forming part 4 in the paper sheet carrying direction. The transfer paper sheet is sandwiched and heated between a heat roller and a pressure roller that is pressed to the heat roller of the fixing roller pair 19, so that the toner image is fixed on the transfer paper sheet.

Next, the transfer paper sheet on which the image is formed in the process from the image forming part 4 to the fixing roller pair 19 is ejected by an ejection roller pair 20 to a paper sheet ejection part 51, and the transfer paper sheets are stacked on the paper sheet ejection part 51 that is disposed so as to protrude from the apparatus. On the other hand, toner remaining on the surface of the photoconductor 12 after the transferring process is removed by the cleaning unit 16, and electric charge remaining on the surface of the photoconductor 12 is removed by the antistatic unit 17. Then, the photoconductor 12 is electrostatically charged again by the electrification unit 13, and a next image forming process is performed in the same manner.

First Embodiment

Figure 2:
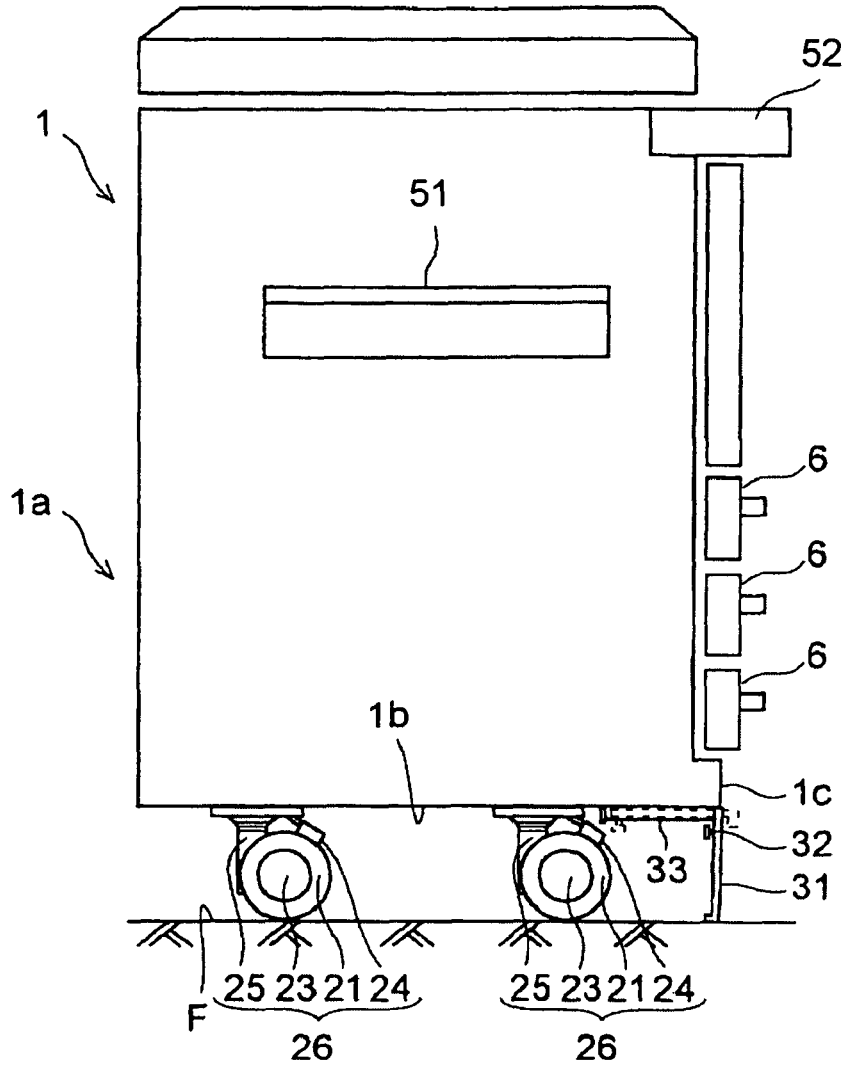
FIG. 2 is a side view showing a structure of the image forming apparatus as a first embodiment of the present invention.
Figure 3:
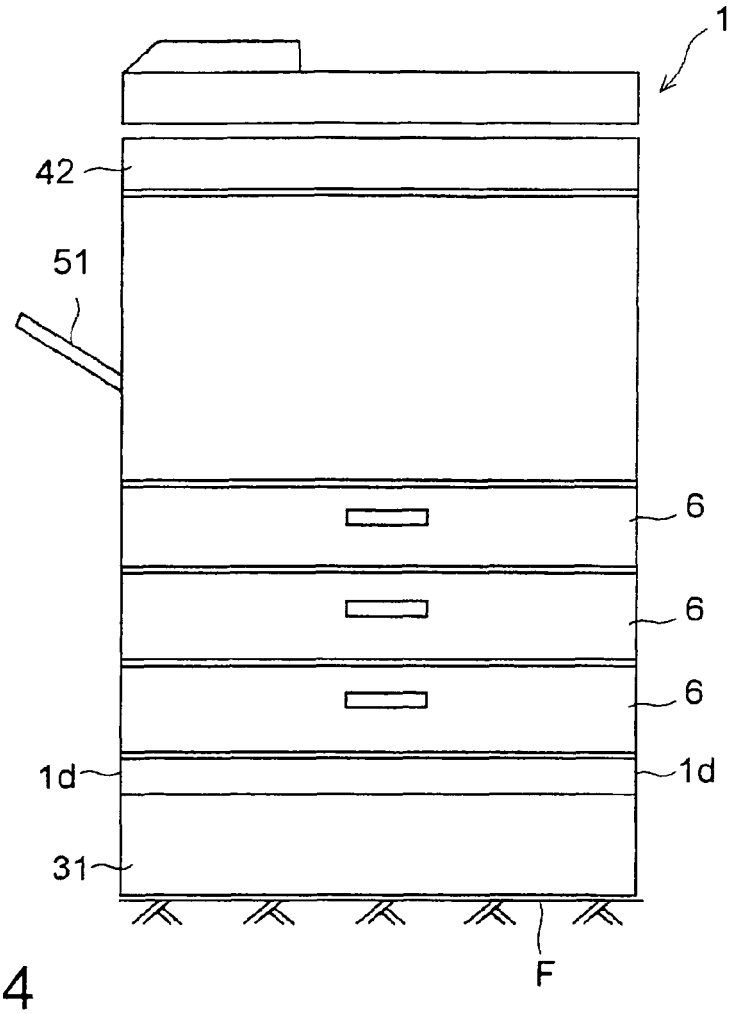
FIG. 3 is a front view showing a structure of the image forming apparatus as the first embodiment of the present invention.
Figure 4:
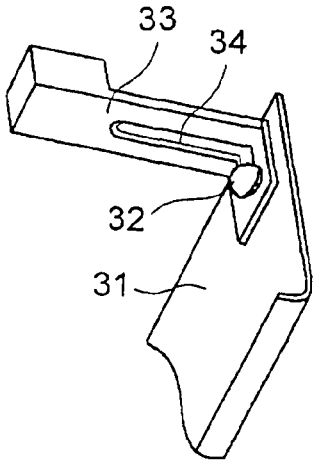
FIG. 4 is a perspective view showing a shield member of the image forming apparatus as the first embodiment of the present invention.

FIGS. 2 and 3 are schematic diagrams showing appearance structures of an image forming apparatus 1 according to a first embodiment of the present invention. FIG. 2 shows a side view of the image forming apparatus 1, and FIG. 3 shows a front view of the image forming apparatus 1 with the paper feed cassettes, an operation panel and the like. FIG. 4 is a perspective view showing a shield member viewed from the floor surface side.

As shown in FIG. 2, the paper feed cassette 6 and an operation panel 52 are disposed on the front face 1*c* of the image forming apparatus 1. Paper feeding of the paper feed cassette 6 and operation of the operation panel 52 are performed from the front face 1*c* side of the image forming apparatus 1. The operation panel 52 may be disposed on the upper face or a side face of the image forming apparatus 1. The front face is regarded as a side to which a user faces the apparatus when operations are performed for copying or printing by the image forming apparatus 1. Casters 21 are disposed at vicinities of four corners on a bottom face 1*b* of a cabinet 1*a* of the image forming apparatus 1. A shaft part 23 is attached to each of the casters 21, so that each of the casters 21 is supported in a rotatable manner by a support member 25 that is attached to the bottom face 1*b* of the cabinet 1*a* via the shaft part 23. The support member 25 is provided with a lock 24 for stopping rotation of the caster 21. The caster 21, the shaft part 23, the lock 24 and the support member 25 constitute a foot member 26. The caster is rolled on the floor surface F so that the image forming apparatus 1 is moved. When the image forming apparatus 1 is installed, the caster 21 is stopped by the lock 24 so that the image forming apparatus 1 is supported on the floor surface F.

In addition, a shield member 31 is disposed at a gap formed between the bottom face 1*b* of the cabinet 1*a* and the floor surface F on the front face 1*c* side of the apparatus. The shield member 31 shields substantially the entire range of the gap on the front face 1*c* side of the apparatus (see FIG. 3). The shield member 31 is like a plate, and two slide shafts 32 are attached to the back face of the shield member 31 on both sides along the side faces 1*d*. The slide shaft 32 has a structure for being held in a movable manner inside a guide member 33 attached to the bottom face 1*b*. As shown in FIG. 4 in detail, the slide shaft 32 is guided by a guide groove 34 that is provided to the guide member 33. The guide groove 34 is made up of a linear groove extending in the direction along the bottom face 1*b* and a linear groove 34 extending in the direction along the front face 1*c*. Therefore, when the slide shaft 32 is guided by the guide groove 34 extending in the direction along the bottom face 1*b*, the shield member 31 is stored along the bottom face 1*b* as shown in FIG. 2 with a broken line. When the slide shaft 32 is guided by the guide groove 34 extending in the direction along the front face 1*c*, the shield member 31 is exposed at the front face 1*c* so as to shield the bottom face 1*b* and the floor surface F.

When the image forming apparatus 1 having the above-mentioned shield member 31 is installed, the caster 21 is stopped by the lock 24 so that the image forming apparatus 1 is supported securely on the floor surface F. If the shield member 31 is pulled out to the front face 1*c* side so as to shield the gap formed between the bottom face 1*b* of the cabinet 1*a* and the floor surface F, a foreign matter such as an original sheet or a sheet of paper does not slip into the gap.

Second Embodiment

Figure 5:
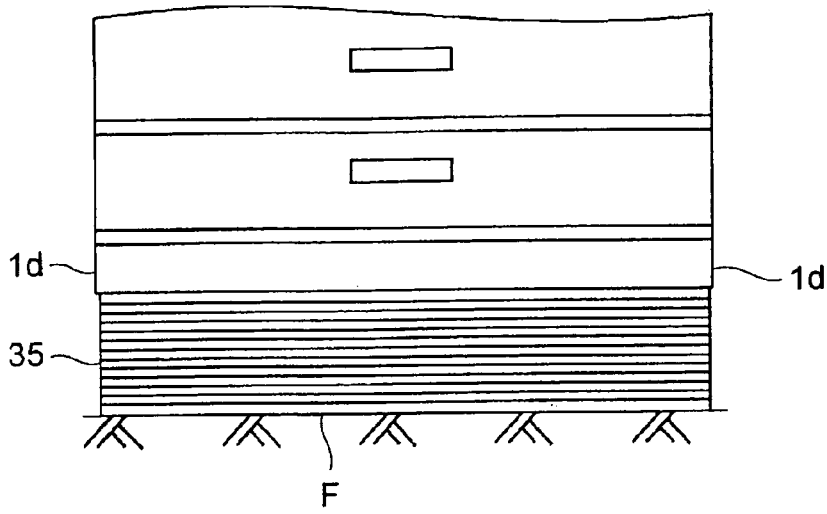
FIG. 5 is a front view showing a structure of an image forming apparatus as a second embodiment of the present invention.
Figure 6:
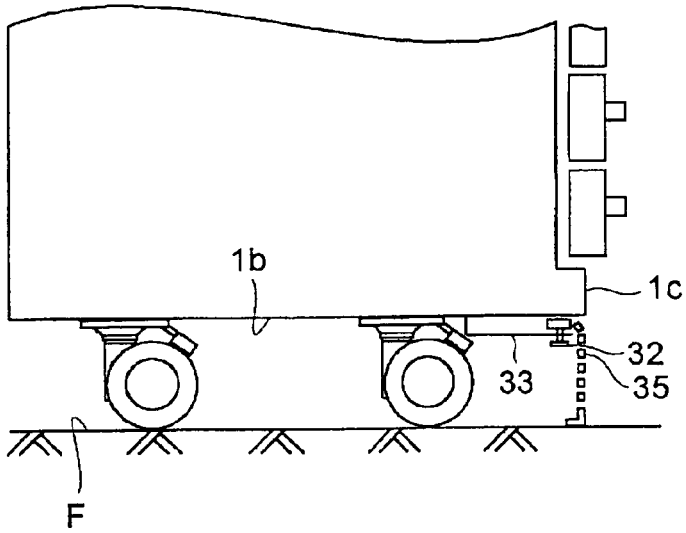
FIG. 6 is a side view showing a structure of the image forming apparatus as the second embodiment of the present invention.

FIGS. 5 and 6 are schematic diagrams showing appearance structures of an image forming apparatus 1 according to a second embodiment of the present invention. FIG. 5 shows a front view of the image forming apparatus 1 with the paper feed cassettes, an operation panel and the like while FIG. 6 shows a side view of the image forming apparatus 1. Hereinafter, a shield member 35 in this embodiment that is different from that in the first embodiment will be described while descriptions of the same parts as the first embodiment will be omitted.

As shown in FIG. 5, the shield member 35 has a structure in which a plurality of band-like plates elongated on the side along the side face 1*d* of the apparatus (in the lateral direction of the apparatus, i.e., in the left and right direction in FIG. 5) are arranged in parallel in the vertical direction of the apparatus and are linked with each other, so as to shield the gap between the bottom face 1*b* of the cabinet 1*a* and the floor surface F. In order to store away the shield member 35 in the state of shielding the gap as shown in FIG. 6 along the bottom face 1*b* of the cabinet 1*a*, the shield member 35 is pulled up so that the slide shaft 32 of the shield member 35 is guided along the guide groove of the guide member 33. Thus, the shield member 35 is stored along the bottom face 1*b*. Since the shield member 35 is made up of the plurality of band-like plates as described above, the shield member 35 can be moved easily between the positions for storing and shielding.

Third Embodiment

Figure 7:
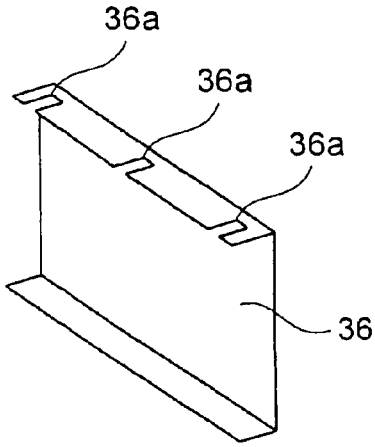
FIG. 7 is a perspective view showing a shield member of an image forming apparatus as a third embodiment of the present invention.
Figure 8:
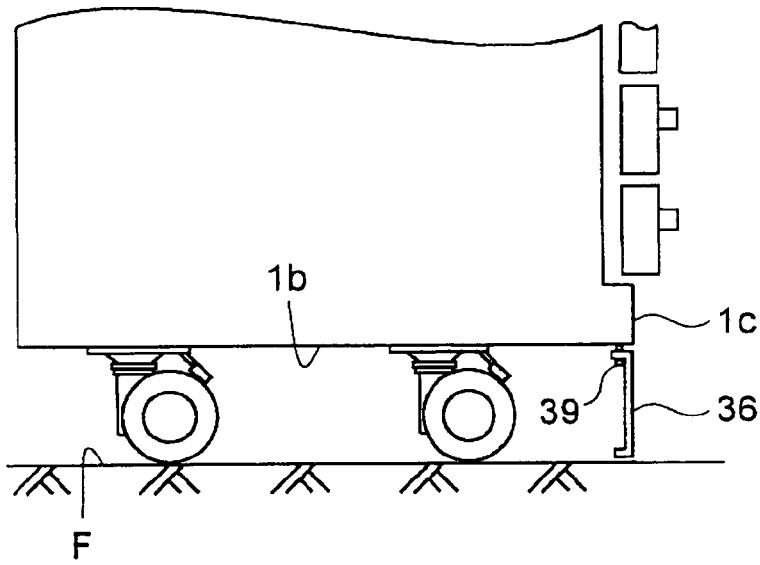
FIG. 8 is a side view showing a structure of the image forming apparatus as the third embodiment of the present invention.

FIGS. 7 and 8 show an image forming apparatus 1 according to a third embodiment of the present invention. FIG. 7 is a perspective view showing a structure of a shield member, and FIG. 8 is a side view showing a structure of the image forming apparatus 1.

As shown in FIG. 7, a shield member 36 is made of a plate having a U-shaped cross section and has three notches 36*a* on the upper side. Pins 39 are attached to the bottom face 1*b* of the cabinet 1*a* as shown in FIG. 8. When the notches 36*a* of the shield member 36 are engaged with the pins 39, the shield member 36 is set to a position for shielding the gap between the bottom face 1*b* and the floor surface F.

Fourth Embodiment

Figure 9:
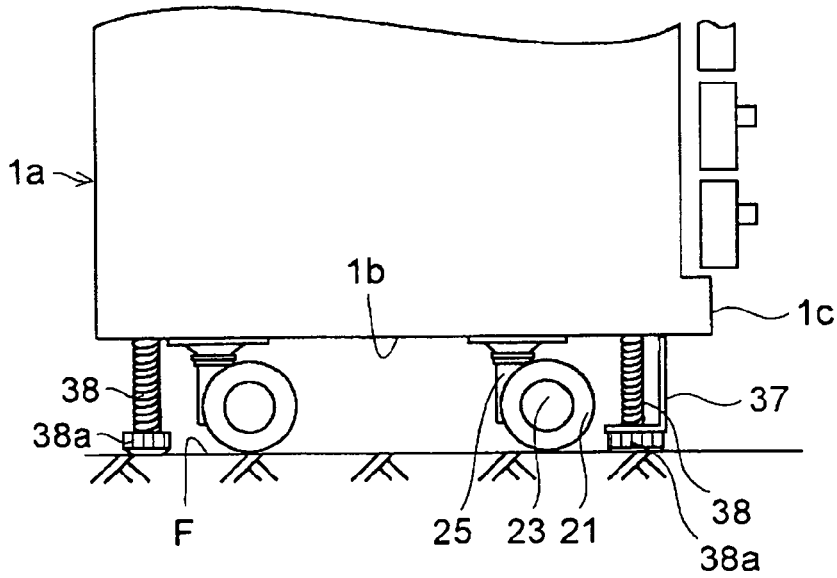
FIG. 9 is a side view showing a structure of an image forming apparatus as a fourth embodiment of the present invention.

FIG. 9 is a side view showing a structure of an image forming apparatus 1 according to a fourth embodiment to the present invention.

The casters 21 are disposed at vicinities of four corners on the bottom face 1*b* of the cabinet 1*a* of the image forming apparatus 1. A shaft part 23 is attached to each of the casters 21, so that each of the casters 21 is supported in a rotatable manner by the support member 25 that is attached to the bottom face 1*b* of the cabinet 1*a* via the shaft part 23. Four knurl screws 38 are attached to the bottom face 1*b* of the cabinet 1*a* on the outer side of the apparatus than the caster 21 in a movable manner in the vertical direction of the apparatus. When a knob 38*a* is turned, the knurl screw 38 moves in the vertical direction of the apparatus. If the knurl screw 38 moves downward, it can support the apparatus on the floor surface F.

A shield member 37 that can be stored along the bottom face 1*b* is supported on the upper surfaces of the knobs 38*a* that are provided to the two knurl screws 38 on the side of the front face 1*c*. When the knurl screw 38 moves in the vertical direction, the shield member 37 also moves in the vertical direction following the same. Therefore, if the knurl screw 38 is moved downward for installing the apparatus, the shield member 37 stored along the apparatus moves downward so as to be positioned for shielding the gap between the bottom face 1*b* and the floor surface F.

Fifth Embodiment

Figure 10:
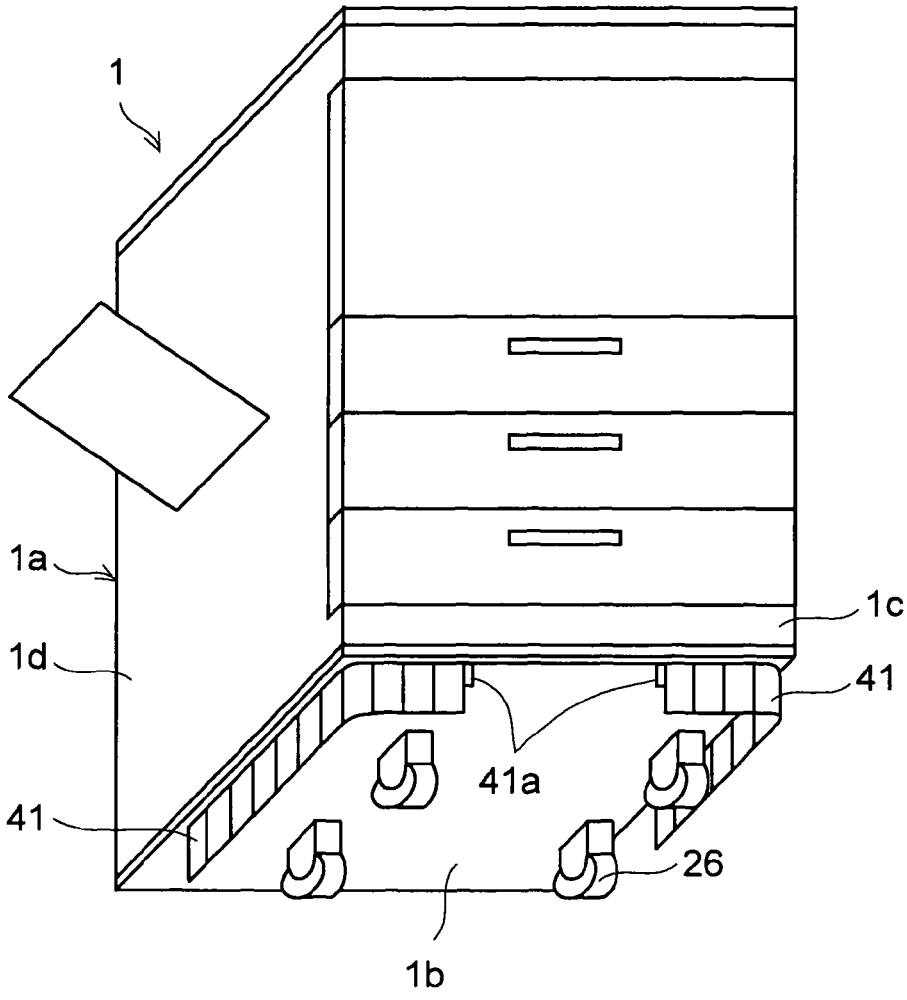
FIG. 10 is a perspective view showing a structure of an image forming apparatus as a fifth embodiment of the present invention.
Figure 11:
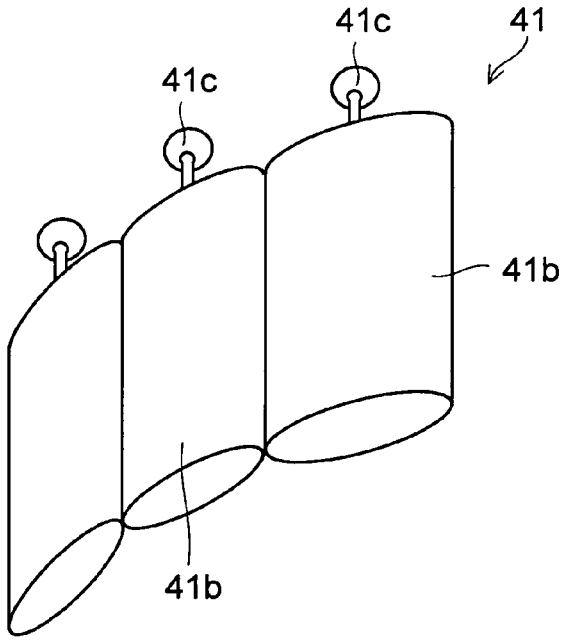
FIG. 11 is a perspective view showing a shield member of the image forming apparatus as the fifth embodiment of the present invention.
Figure 12:
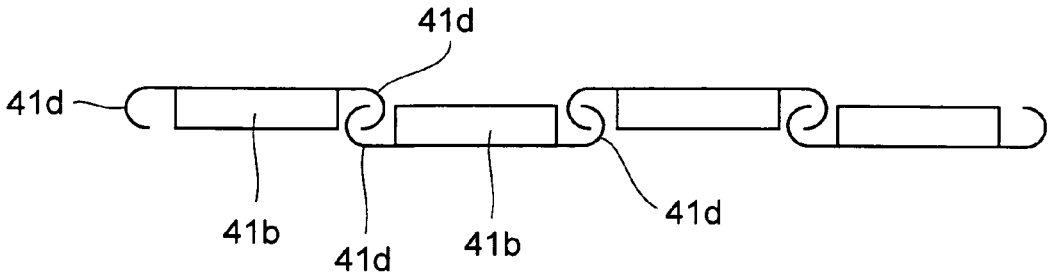
FIG. 12 is a plan view showing the shield member of the image forming apparatus as the fifth embodiment of the present invention.
Figure 13:
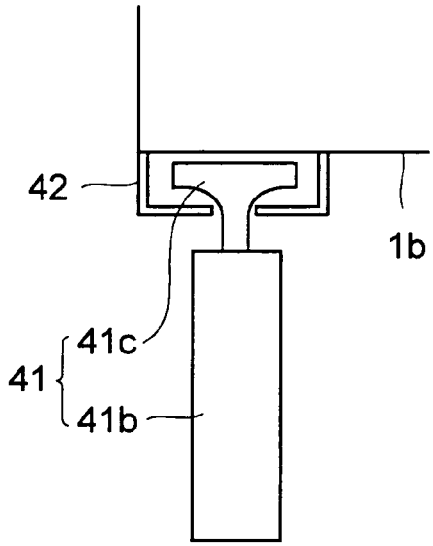
FIG. 13 is a cross sectional view showing the shield member of the image forming apparatus as the fifth embodiment of the present invention.

FIGS. 10 to 13 show an image forming apparatus according to a fifth embodiment of the present invention. FIG. 10 is a perspective view showing a structure of the image forming apparatus, FIG. 11 is a perspective view showing a shield member, FIG. 12 is a plan view showing the shield member, and FIG. 13 is a cross section of the shield member attached to a cabinet.

As shown in FIG. 10, the shield members 41 are disposed at a gap formed between the bottom face 1*b* of the cabinet 1*a* and the floor surface in a manner capable of moving between the front face 1*c* and the side face 1*d* of the apparatus. The shield members 41 are disposed from one of the side faces 1*d* to the front face 1*c* and from the other side face 1*d* to the front face 1*c* so that they can move from both the side faces 1*d* to the front face 1*c* of the apparatus for shielding the gap of the front face 1*c*. When both the shield members 41 are moved to the front face 1*c* side, magnets 41*a* disposed at ends of the shield members 41 contact with each other. Therefore, the shield members 41 are held in a state of intimate contact with each other by the magnets 41*a* so that the gap of the front face 1*c* is shielded. In this case, the shield members 41 also shield partially gaps of both the side faces 1*d* of the apparatus. Furthermore, it is possible to adopt another structure in which the shield member 41 is disposed only at one of the side faces 1*d* and moves to the front face 1*c* side so as to shield the gap of the front face 1*c*.

As shown in FIG. 11, the shield member 41 includes a plurality of shield pieces 41*b* having a substantially rectangular box shape, guide salients 41*c* provided to upper parts of the individual shield pieces 41*b* and hook parts 41*d* (see FIG. 12), which are made of resin.

The shield piece 41*b* has a rectangular box shape elongated in the vertical direction of the apparatus, and its length is substantially the same as a height of the gap formed between the bottom face 1*b* of the cabinet 1*a* and the floor surface. The plurality of shield pieces 41*b* are arranged in the lateral direction (horizontal direction) of the apparatus so that they are neighboring to each other.

As shown in FIG. 12, the hook part 41*d* is formed to have a hooked shape and engages with the neighboring hook part 41*d* in a pivotable manner. Therefore, the plurality of linked shield pieces 41*b* can be bent at the hook parts 41*d* in accordance with arrangement directions of the shield pieces 41*b*.

As shown in FIG. 13, the guide salient 41*c* is engaged with the guide groove 42 disposed continuously along a vicinity of the front face 1*c* and the side face 1*d* on the bottom face 1*b* of the cabinet 1*a* in a movable manner. When the shield member 41 is pulled out from the side face 1*d* to the front face 1*c* of the apparatus, the guide salients 41*c* are guided by the guide groove 42 so as to move from the side face 1*d* to the front face 1*c* via a corner between the side face 1*d* and the front face 1*c*. Thus, the plurality of shield pieces 41*b* shield the gap of the front face 1*c* side.

Sixth Embodiment

Figure 14:
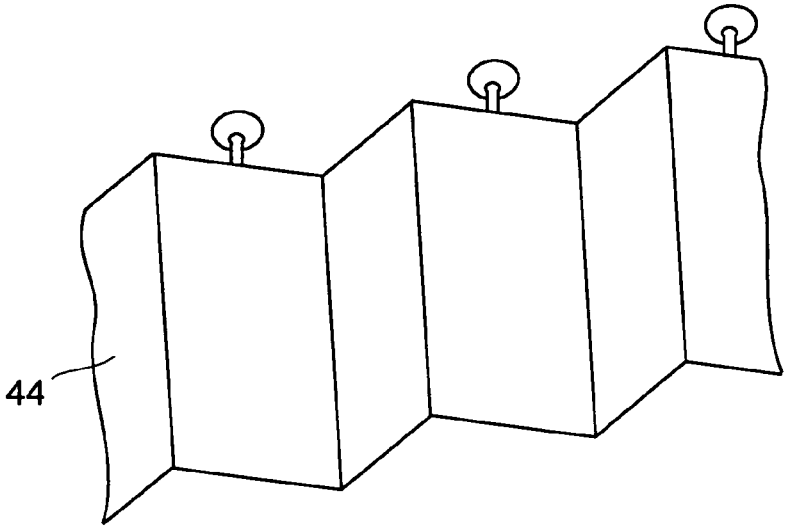
FIG. 14 is a perspective view showing a shield member of an image forming apparatus as a sixth embodiment of the present invention.

FIG. 14 shows a perspective view of a shield member of an image forming apparatus according to a sixth embodiment of the present invention. A shield member 44 is formed like bellows that can be expanded and contracted in the lateral direction of the apparatus, and it has guide salients on the upper part in the same manner as the fifth embodiment. The guide salients are guided by the guide groove so as to move to the front face 1*c* of the apparatus.

Seventh Embodiment

Figure 15:
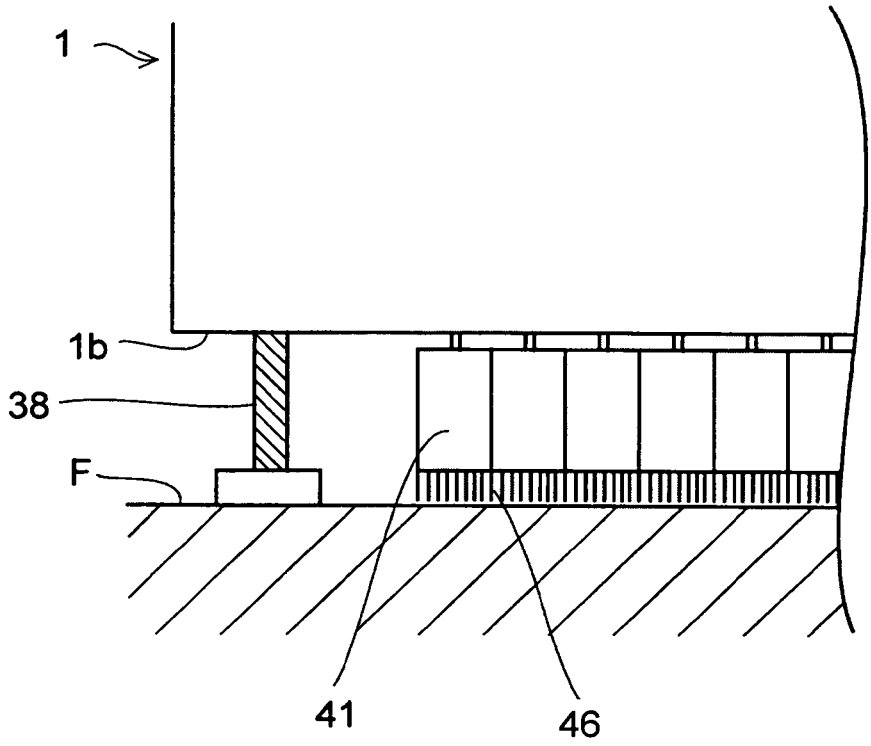
FIG. 15 is a side view showing a structure of a noted part of an image forming apparatus as a seventh embodiment of the present invention.

FIG. 15 shows a side view of an image forming apparatus according to a seventh embodiment of the present invention. The seventh embodiment has a structure in which a flexible member 46 is added to the shield member in the fifth embodiment. More specifically, the flexible member 46 is disposed at the lower part (the end close to the floor surface F) of the plurality of shield pieces 41*b* of the shield member. The flexible member 46 is adapted to have a length such that it can always contact with the floor surface F so as to shield the gap of the front face 1*c* side even if a height of the gap between the floor surface F and the bottom face 1*b* changes for adjusting a height of the apparatus by the plurality of knurl screws 38.

The flexible member 46 is made of a brush, strings or the like having a shape like fibers. Instead of matter having a shape like fibers, a sheet having a shape like cloth such as a sheet of fabric, a nonwoven fabric or the like, or a sheet of an elastic material such as rubber may be used for forming the flexible member 46.

Instead of the above-mentioned structure in which the flexible member 46 is disposed at the lower end of the shield piece 41*b*, the shield member itself may be made of the flexible member 46. In other words, it is possible to adopt another structure in which the flexible member 46 is attached to the bottom face 1*b* of the cabinet so as to contact with the floor surface F.

In addition, instead of the structure of the above-mentioned embodiment, the shield member may have a shape like bellows that can be expanded and contracted in the vertical direction between the bottom face 1*b* and the floor surface F. Alternatively, it may be like a hanging curtain or may be made of a plurality of plates arranged like a lattice.

The present invention can be used for an image forming apparatus such as a copying machine, a printer or a facsimile. In particular, the present invention can be used for an image forming apparatus having foot members for supporting the apparatus on the floor surface.

What is claimed is:

1. An image forming apparatus comprising:

an apparatus cabinet having a bottom face opposed to a floor surface and a front face for operating the apparatus;

a plurality of foot members disposed on the bottom face for supporting the apparatus on the floor surface in a movable manner; and a shield member, fitted to the bottom face, for substantially shielding an entire gap formed between the bottom face and the floor surface at least at the side of the front face of the apparatus.

2. The image forming apparatus according to claim 1, wherein the shield member is capable of moving between a position for shielding the gap and a position for being stored at the bottom face.

3. The image forming apparatus according to claim 2, wherein the shield member has a sheet-like shape.

4. The image forming apparatus according to claim 3, wherein the shield member is provided with a shaft, and the bottom face is provided with a guide member, so that the shaft is guided by a groove that is formed in the guide member.

5. The image forming apparatus according to claim 2, wherein the shield member is made up of a plurality of band-like plates.

6. The image forming apparatus according to claim 5, wherein each band-like plate extends in the lateral direction of the apparatus, and the plurality of band-like plates are arranged in the vertical direction of the apparatus and are linked with each other.

7. The image forming apparatus according to claim 6, wherein the shield member is provided with a shaft, and the bottom face is provided with a guide member, so that the shaft is guided by a groove that is formed in the guide member.

8. The image forming apparatus according to claim 1, wherein the shield member is detachable from the apparatus.

9. The image forming apparatus according to claim 8, wherein the shield member has a sheet-like shape.

10. The image forming apparatus according to claim 1, wherein the foot member includes a caster that can rotate for moving on the floor surface and a fixed foot member that can move between the floor surface and the bottom face, and the shield member moves between the floor surface and the bottom face along with the movement of the fixed foot member.

11. The image forming apparatus according to claim 1, wherein the shield member is capable of moving between a front face gap formed at a front face side of the apparatus and a side face gap formed at a side face side of the apparatus.

12. The image forming apparatus according to claim 11, wherein the shield member is capable of moving between the front face gap and one of the side face gaps.

13. The image forming apparatus according to claim 12, wherein the shield member includes a plurality of shield pieces, each of which has a rectangular box shape elongated in the vertical direction of the apparatus, and the plurality of shield pieces are arranged in the lateral direction of the apparatus and are linked with each other.

14. The image forming apparatus according to claim 11, wherein a pair of the shield members are disposed, each of which is capable of moving between the front face gap and the side face gap.

15. The image forming apparatus according to claim 14, wherein the shield member includes a plurality of shield pieces, each of which has a rectangular box shape elongated in the vertical direction of the apparatus, and the plurality of shield pieces are arranged in the lateral direction of the apparatus and are linked with each other.

16. The image forming apparatus according to claim 14, wherein the shield member has a shape like bellows that can be expanded and contracted in the lateral direction of the apparatus.

17. The image forming apparatus according to claim 1, wherein the shield member includes a plurality of shield pieces arranged in the lateral direction of the apparatus so as to link with each other, and a flexible member attached to the plurality of shield pieces at the end close the floor surface side.

18. The image forming apparatus according to claim 17, wherein the flexible member has a shape like cloth.

19. The image forming apparatus according to claim 17, wherein the flexible member is formed to have a shape like fibers.

20. The image forming apparatus according to claim 1, wherein the shield member is made of a flexible member.

* * * * *